United States Patent [19]

LeBlanc et al.

[11] 4,241,506

[45] Dec. 30, 1980

[54] SKATER'S DEVICE

[76] Inventors: Edgar J. LeBlanc, 73 Pond St., rear; Lawrence Venezia, 54 Union St.; Timothy Kinchla, 19 Grant St., all of Natick, Mass. 01760

[21] Appl. No.: 946,807

[22] Filed: Sep. 28, 1978

[51] Int. Cl.[3] ..... B43L 9/04

[52] U.S. Cl. ..... 33/27 C; 33/158

[58] Field of Search ..... 33/27 C, 158, 159, 160, 33/161

[56] References Cited

U.S. PATENT DOCUMENTS

| | | | |
|---|---|---|---|
| 534,152 | 2/1895 | Heinkel et al. | 33/158 |
| 660,688 | 10/1900 | Lipsy | 33/158 X |
| 1,661,136 | 2/1928 | Endrezze | 33/158 X |
| 2,086,402 | 7/1937 | Countryman | 33/138 X |
| 2,355,585 | 8/1944 | Halstead | 33/27 C |

FOREIGN PATENT DOCUMENTS

| | | | |
|---|---|---|---|
| 907303 | 6/1945 | France | 33/158 |
| 6191 | 1/1895 | Sweden | 33/27 C |
| 273105 | 6/1927 | United Kingdom | 33/27 C |

*Primary Examiner*—Harry N. Haroian

*Attorney, Agent, or Firm*—Joseph H. Killion

[57] ABSTRACT

We have discovered a Skater's Device which comprises a telescoping tubular member extensible over a range of positions from a first innermost position to a second outermost position, thereon. Scribing means are fixedly positioned at one end of said telescoping tubular member and releasable locking means are connected to said telescoping tubular member to retain said telescoping tubular member at the desired position. The center pin means are fixedly positioned at the other end of said telescoping tubular member to fix and retain the center point. A toe loop scribing means is longitudinally and adjustably mounted to said telescoping tubular member to scribe a toe-loop circle tangent to the circle scribed by said scribing means.

3 Claims, 6 Drawing Figures

SKATER'S DEVICE

BACKGROUND OF THE INVENTION

Mastery of the sport of figure skating involves mastery of the four basic ice-skate blade edges. The four edges consist of the outer edges with each foot and the inner edges with each foot. The mastery of these edges is reflected in the compulsory skating figures such as the circle 8, the waltz 3, the double 3, brackets, counters, rockers, loops, etc., and are basic for advanced skating such as free skating.

It is incumbent then upon the person desiring to be proficient in figure skating to practice circles with the four basic edges. The figure 8 is the most important figure since its mastery involves the use of all four edges.

Various devices, for the most part homemade, have been utilized in the past by skaters, to practice figure 8's . A problem arises with respect to these devices in that the height of the skater must be taken into account as the stroke length will be different for a 5 foot tall skater then a 6 foot tall skater. Most of these homemade devices have been tailor-made for a particular skater. Certain other devices have been made adjustable so that they compensate for the variation in the skater's height. However, most of these devices are crude, difficult to manipulate and not amenable to inexpensive mass production.

Another problem involves the making of a so called "toe-loop". At the outermost edges of the figure 8 is the location where the skater penetrates the circle, "loops" and goes back onto the circumference of the circle with the other foot. This is a most critical maneuver and the performance of the skater is judged as to the accuracy of the reentry on the other foot. In the past, a "trainer" would skate the traced figure 8 and make the "toe-loop" for the skater to practice on. Since the "toe-loop" is a function not only for the skater's ability but also of the length of the blades (the diameter of the "toe-loop" being about one and one-half times the length of the blade) not only does practice of necessity involve the making of the "toe-loop" by the "trainer" but also of a "trainer" with a similar blade length.

There is then a need for a skater's device which is readily adjustable for the skater's height and which when scribing incorporates a "toe-loop" proportional to the length of the skater's blade, tangental to the outermost edge of the circumference of each circle of the figure 8.

SUMMARY OF INVENTION

Our invention relates to an improved skater's device and an improved method for making practice figure 8's including a toe-loop.. Our skater's device for scribing practice figure 8's comprises a telescoping tubular member extensible over a range of positions from a first innermost position to a second outermost position. A scribing means is fixedly positioned at one end of said telescoping tubular member and releasable locking means are provided to retain said telescoping tubular member at the desired position. A center pin means is fixedly positioned in the ice at the other end of said telescoping tubular member to fix and retain the center point of the circle to be scribed. An adjustable toe-loop scribing means is connected to the telescoping tubular member near the center pin means to simultaneously scribe a toe-loop circle tangental to the outermost side of the figure 8. Our method for scribing practice figure 8's for skaters comprises the steps of adjusting a skater's device for the height of a skater, adjusting the toe-loop scriber for the length of the skater's blade, scribing simultaneously a first circle with an inner circle tangent to the circumference, scribing a second circle with an inner circle tangent the circumference touching the first circle so that the inner tangental circles are adjacent the ends of a figure 8 formed thereby.

We prefer that our invention be made from a strong and durable material, particularly a metal, and more particularly aluminum, so that it will be light and readily usable, but yet strong enough to maintain mechanical accuracy.

It is preferred but optional to our invention that a handle means be incorporated above the center pin means so that the user may utilize the device easily when scribing a circle and also readily exert downward force so that the scribe cuts a circle deep enough to be utilized for the practicing of figure 8's. We prefer that the point portion of the scribing means be a hard and durable material, preferably a carbide material, so that it will be durable in use. Optionally we include a scribe-guard for all scribing means to protect the tips and the user.

Our invention provides numerous advantages over those devices found in the prior art. It is an advantage of our invention that it is adjustable to the height and blade length of the vast majority of potential users. It is a further advantage of our invention that it is collapsible up to a readily transported package. Further advantages of our invention are that the skater's device is strong and durable, simple to manufacture, efficient and economical.

These and other objects are accomplished by the parts, construction, arrangements, combinations and sub-combinations comprising the present invention the nature of which is set forth in the following general statement and the preferred embodiments of which—illustrative of the best modes in which applicants have comtemplated the principles—are set forth in the following drawings and description which are particularly and distinctively set forth and pointed out in the appended claims forming a part thereof.

DETAILED DESCRIPTION OF THE DRAWINGS

Figure 1:
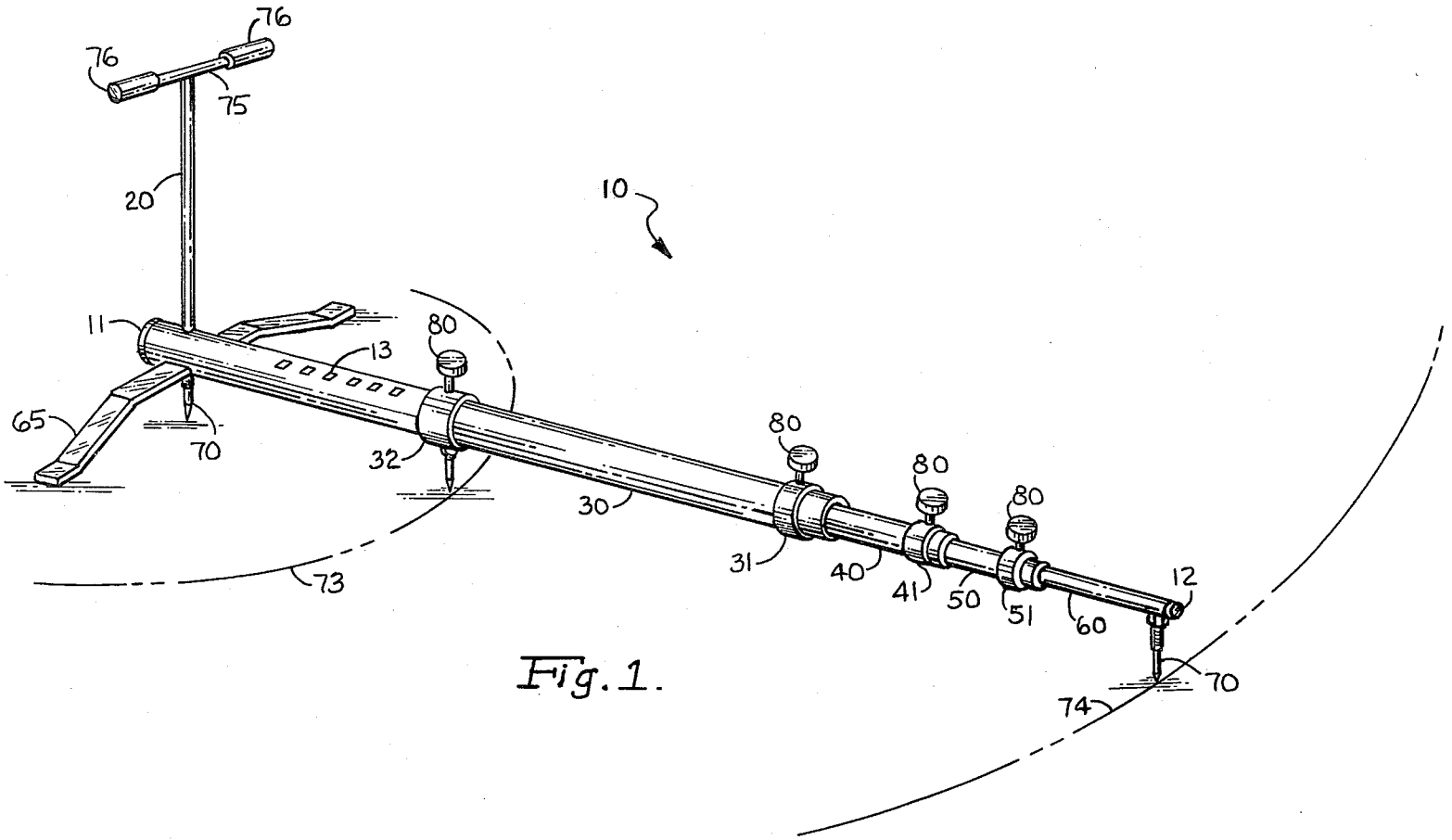
FIG. 1 is a perspective, illustrative, isometric view of our skater's device.

Referring now in particular to the accompanying drawings, our skater's device is generally indicated at 10, in FIG. 1, and includes outer tubular member 30, first extension 40, second extension 50 and third extension 60. After the skater's device is extended to approximately three times the skater's height these extensions are locked, by tightening extension clamps 31, 41 and 51, each of which includes a locking screw 81, having locking screw cap 80. The locking screw extension clamp 51 adapts into one of a series of depressions 16, located along said third extension, which most closely corresponds to the extension desired. Scribe member 70, including locking nut 71 (FIG. 4) and threads 72, screws in place into their particular position on the skater's device. One scribe member 70, screws into circle scribe member 17. Another scribe member 70, screws into toe-loop positioner 35. The third scribe member screws into set pin positioner 25. Outer tube plug 11 and third extension plug 12, cap the skater's device at either end, including grips 76 and guide-rod handle 75. Guide-rod 20, adapts to outer tube 30 as later described.

Figure 2:
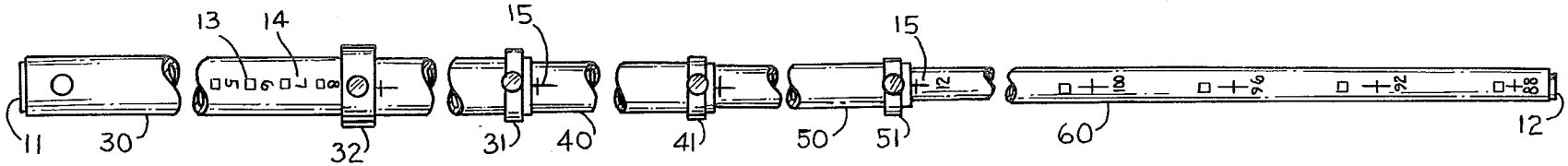
FIG. 2 is a top elevation, partially fragmented view of the skater's device.
Figure 5:
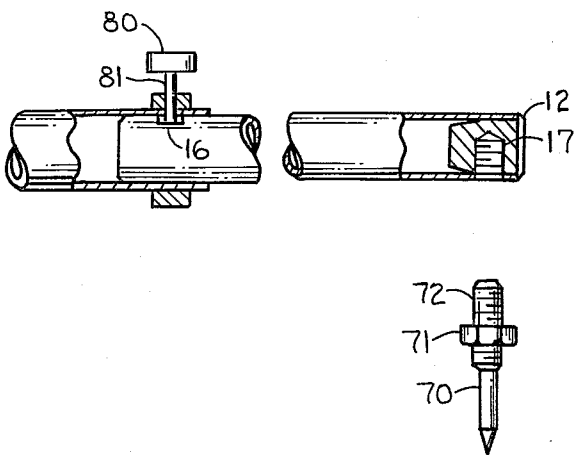
FIG. 5 is a detailed partially fragmented cross-sectional view of the scribing means at the end of the telescoping tubular member.

FIG. 2 shows toe-loop screw locators 13, and toe-loop inch scale 14. Extension inch scale 15, directly relates the overall extension in inches.

Figure 6:
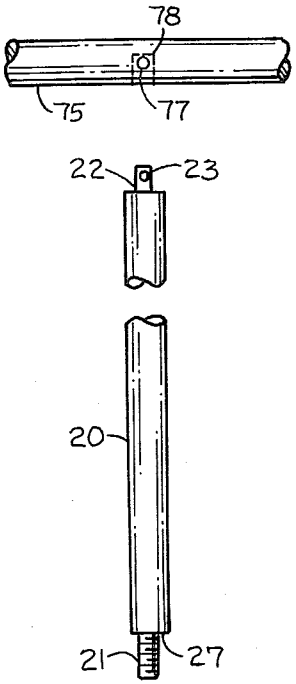
FIG. 6 is a partially fragmented side view of the handle means incorporated in the skater's device.

The guide-rod 20 shown in FIG. 6 includes a handle 75, joined to the guide-rod at upper end 22, aligning roll pin hole 23 of guide rod 20 with handle locator hole 78 of handle 75, and transfixing both by roll pin 77.

The lower end of guide rod 20, includes threaded section 21 and shoulder section 27. The threaded section 21 screws into guide rod support 26, having support shoulder 28, at threaded hole 24.

Support stands 65 are positioned through the outer tube 30, at support hole 61.

Figure 4:
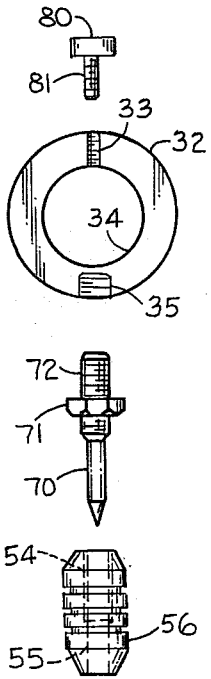
FIG. 4 is a cross-sectional partially fragmented view of the locking means, including a scribe guard.
Figure 3:
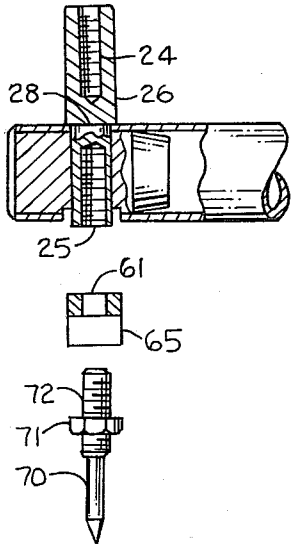
FIG. 3 is a detailed cross-sectional partially fragmented view of the center pin construction.

Toe-loop member 32, fits over outer tube 30, and snugly at inner diameter 34, and includes locking screw thread 33, which pierces the toe-loop member 32 and locking screw 81, having screw cap 80 transfix said toe-loop member, to then adapt through that particular one of the series of toe-loop locator holes 13, decreed by the skater's blade length, and locks the toe-loop member in place on outer tube 30 (FIG. 4).

Scribe guards 56 (FIG. 4), including scribe clearance holes 55, and scribe guard threads 56, fit over each scriber and screw on to scribe threads 72 of said scribe member.

FIG. 1 further shows a segment of the outer circle 74 and the toe-loop 73 which when scribed form half of a figure 8.

In use the tube members are extended to approximately three times the height of the skater and locked into that length. The scribes are screwed into their respective positions and the scribe guards removed. The guide rod is assembled and fitted into place. The toe-loop member is adjusted to approximately one and one-half times the skater's blade length and locked.

The area to be scribed is then chosen and the skater's device positioned to draw the figure 8 with toe-loops. The user then bears down on the handle and scribes the first set of circles. The support legs help the user to balance the skater's device both when not in use and when in use, and in addition, the user may place a foot on the flanged portion of the supporting leg to gain balance and leverage while tracing the circle. The skater's device is then repositioned so that a second set of circles is scribed tangent the first set and with the toe-loop circles at the outer ends of the figure 8.

As illustrated and described our skater's device and method has numerous advantages over present devices, used for making practice figure 8's.

What we claim is:

1. A skater's device for scribing practice circles comprising:

(a) a telescoping tubular member extensible over a range of positions from a first innermost position to a second outermost position thereon;

(b) scribing means fixedly mounted at one end of said telescoping tubular member;

(c) releasable locking means connected to said telescoping tubular member to retain said telescoping member at the desired position;

(d) center pin means fixedly positioned at the outer end of said telescoping tubular member to fix the center point of a circle;

(e) toe-loop scribing means longitudinally adjustable and mounted to said telescoping tubular member;

(f) handle means secured to and extending upwardly and substantially perpendicular from said telescoping tubular member, adjacent and above said center pin means;

(g) support legs secured to and extending substantially downwardly and outwardly from said telescoping tubular member adjacent said center pin means.

2. The skater's device as in claim 1 wherein said toe-loop scribing means further comprises:

(a) a first frame member annularly disposed about said telescoping tubular member, at the top thereof defining a first threaded channel therethrough and substantially opposite said first threaded channel a second threaded channel partially transfixing said frame member;

(b) a locking pin adapting to said first threaded channel moveable between a first position distant said telescoping tubular member and a second position lockingly compressing upon said telescoping tubular member;

(c) scribing means forming at one end thereof a sharpened point and at the other end thereof a threaded end adaptable to said second threaded channel of said toe-loop scribing means.

3. The skating device of claim 2 further comprising:

(a) scribe means guard threadingly engaging said locking pin means and disposed annularly about and covering said scribing means.

* * * * *